US009759099B2

(12) United States Patent
Lengfeld et al.

(10) Patent No.: US 9,759,099 B2
(45) Date of Patent: Sep. 12, 2017

(54) VALVE DRIVE TRAIN DEVICE FOR AN INTERNAL COMBUSTION ENGINE

(71) Applicant: DAIMLER AG, Stuttgart (DE)

(72) Inventors: Markus Lengfeld, Leutenbach (DE); Jens Meintschel, Bernsdorf (DE); Thomas Stolk, Kirchheim (DE); Alexander Von Gaisberg-Helfenberg, Beilstein (DE)

(73) Assignee: DAIMLER AG, Stuttgart (DE)

( * ) Notice: Subject to any disclaimer, the term of this patent is extended or adjusted under 35 U.S.C. 154(b) by 82 days.

(21) Appl. No.: 14/866,872

(22) Filed: Sep. 26, 2015

(65) Prior Publication Data

US 2016/0017763 A1 Jan. 21, 2016

Related U.S. Application Data

(63) Continuation-in-part of application No. PCT/EP2014/000696, filed on Mar. 15, 2014.

(30) Foreign Application Priority Data

Apr. 4, 2013 (DE) ..... 10 2013 005 803

(51) Int. Cl.

| | |
|---|---|
| ***F01L 1/34*** | (2006.01) |
| ***F01L 1/04*** | (2006.01) |
| ***F01L 13/00*** | (2006.01) |
| ***F01L 1/047*** | (2006.01) |

(52) U.S. Cl.

CPC ..... *F01L 1/044* (2013.01); *F01L 1/047* (2013.01); *F01L 13/0036* (2013.01); *F01L 2013/0052* (2013.01)

(58) Field of Classification Search

CPC ..... F01L 1/044; F01L 1/047; F01L 13/0036; F01L 2013/0052

USPC ..... 123/90.16, 90.18, 90.6

See application file for complete search history.

(56) References Cited

U.S. PATENT DOCUMENTS 8,997,706 B2 * 4/2015 Stolk ..... F01L 13/0036 123/90.18

2012/0138001 A1 6/2012 Werler

FOREIGN PATENT DOCUMENTS

| | | | |
|---|---|---|---|
| DE | 10 2007 048 915 | A1 | 4/2009 |
| DE | 10 2008 054 254 | A1 | 5/2010 |
| DE | 10 2008 064 340 | A1 | 6/2010 |
| DE | 10 2009 007 819 | A1 | 8/2010 |
| DE | 10 2010 013 216 | A1 | 10/2010 |
| WO | 2006/012959 | A1 | 2/2006 |

* cited by examiner

*Primary Examiner* — Ching Chang

(74) *Attorney, Agent, or Firm* — Klaus J. Bach

(57) ABSTRACT

In a valve drive train device for an internal combustion engine of motor vehicle, wherein at least one axially movably mounted cam element including at least one cam set with at least two cam parts and a shifting gate with at least two gate track for converting a rotary movement of the cam element into an axial shifting motion, at least one of the cam parts and the adjacent gate track are disposed in an at least partially axially overlapping relationship for reducing thereby the axial length and the mass of the cam element or permitting the use of a larger, highly durable, actuating mechanism.

10 Claims, 1 Drawing Sheet

VALVE DRIVE TRAIN DEVICE FOR AN INTERNAL COMBUSTION ENGINE

This is a Continuation-In-Part application of pending international patent application PCT/EP2014/000696 filed Mar. 15, 2014 and claiming the priority of German patent application 10 2013 005 803.1 filed Apr. 4, 2013.

BACKGROUND OF THE INVENTION

The invention relate to a valve drive train device for an internal combustion engine comprising a camshaft with an axially movable cam element provided with at least two cams and a shifting gate for axially moving the cam element.

A valve drive train device for an internal combustion engine of a motor vehicle is already known for example from DE 10 2008 064 340 A1. This device comprises at least one axially movably mounted cam element, which has at least one cam set with at least two cam parts and a shifting gate with at least one gate track, which is provided in order to convert a rotary movement of the cam element into an axial shifting motion.

It is the principal object of the present invention to provide a valve drive train device for an internal combustion engine, which has an increased shifting flexibility and as a result in particular provides for further fuel savings in the operation of the internal combustion engine.

SUMMARY OF THE INVENTION

In a valve drive train device for an internal combustion engine of a motor vehicle, wherein at least one axially movably mounted cam element has at least one cam set with at least two different cams and a shifting gate with at least two gate tracks for converting a rotary movement of the cam element into an axial shifting motion, at least one of the cam parts and at least one of the gate tracks are disposed in an at least partially axially overlapping relationship for reducing thereby the axial length and the mass of the cam element or permitting the use relatively large actuating elements without increasing the axial length and mass of the cam element.

In this way, the valve drive train device as a whole can be designed with a higher mechanical load capacity, so that switch-overs of the cam elements can be carried out at higher speeds of the internal combustion engine. As a result, the shifting flexibility of the valve drive train device is increased, since shifting operations can be carried out in a greater speed range. Thus additional fuel savings are possible with a valve drive train device according to the invention.

A "cam with at least two cam parts" should be understood to mean in particular an individual cam for actuating one single gas change valve, having at least two cam parts with different cam curves, which cam parts are provided for actuating the same gas change valve. The cam parts are preferably disposed directly adjacent each other, whereby, by an axial displacement of the cam element, it is possible to change over between operations by one of the at least two cam parts. A "cam element" should in particular be understood to be a component which has the at least one cam provided for actuating the gas change valve. An "axially movable cam element" should in particular be understood to be a cam element which is mounted so as to be axially movable relative to a cylinder head or another fixed component of the internal combustion engine. The expression "axially" relates in particular to a main axis of rotation of the at least one cam element, so that the term "axially" designates a direction which extends on the main axis of rotation or parallel thereto. A "valve stroke changeover" should be understood in particular as a separate changeover between at least two valve actuating cams which define an actuation of at least one gas change valve. A "gate track" should in particular be understood to be a track to a positive guide of a gate engagement element at least on one side, preferably on both sides. The gate track is preferably designed in the form of a web, a slot and/or a groove. "At least partially axially overlapping" should in particular be understood to mean that an axial part-region of the cam element, in which the cam part is disposed, and an axial part-region of the cam element, in which the gate track is disposed, at least partially overlap. In this context an "axial part-region" should be understood in particular to be a part-region of the cam element which is defined by a maximum axial extent of the cam part or the gate track. "Provided" should be understood in particular to mean specially programmed, designed, equipped and/or disposed.

Preferably, the cam part has a base circle phase, in which the gate track and the cam part are disposed axially overlapping. As a result it is possible to prevent a surface pressure on the cam part during actuation of the gas change valve from becoming too high, so that damage to the cam part can be avoided. In this context an "overlapping arrangement in the base circle phase" should in particular be understood to mean that the gate track and the cam part are merely disposed overlapping in the base circle phase. In this context an "overlapping arrangement in the base circle phase" should in particular be understood to mean that the gate track and the cam part are merely disposed overlapping in the base circle phase.

The valve drive train device preferably has an overlap width of at least 10% of a cam part width. As a result, an available installation space for the shifting gate can be enlarged sufficiently in order to increase the load capacity of the shifting gate. An "overlap width" should in particular be understood to mean a width of an axial part-region of the cam element in which the cam part and the gate track are disposed overlapping. In this case a "cam part width" should in particular be understood to mean a width of the part-region of the cam element which is defined by the maximum axial extent of the cam part.

The overlap width is preferably at most 50% of a cam part width. As a result it is possible to avoid an excessively great surface pressure on the cam part. In principle, however, an overlap width greater than 50% of the cam part width is conceivable.

Furthermore it is proposed that the cam element has at least one second cam with at least two cam parts and the shifting gate is disposed axially between the at least two cams. As a result, a particularly compact valve train can be implemented which has an advantageously high shifting flexibility. In this context, "axially between" should in particular be understood to mean that the shifting gate and the two cams border one another directly in the axial direction and/or are disposed axially overlapping, wherein the two cams are preferably provided for gas change valves of one and the same cylinder.

Also, the shifting gate has a second gate track which is disposed at least partially in axially overlapping relationship with at least one of the cam parts of the second cam. As a result, further installation space for the shifting gate can be provided, so that the dimensioning and thus the load capacity of the shifting gate can be further improved. In addition, the at least one gate track preferably has an engagement segment and/or a disengagement segment which is disposed in axially overlapping relationship with the at least one cam part. As a result, the at least one gate track and the cam part can particularly advantageously be disposed overlapping in the circumferential direction, so that the overlapping arrangement can extend over an acceptable advantageous angular range. In this case, an "engagement segment" should be understood in particular to mean a part-region of the gate track which constitutes a start of the gate track. In this case, an "engagement segment" should be understood in particular to mean a part-region of the gate track which constitutes an end of the gate track. The engagement segment and the disengagement segment preferably extend at least substantially in the circumferential direction, i.e. the cam element is not subjected to a shifting force.

In an advantageous configuration, the at least one cam set has a third cam. In this way a shifting flexibility can be further increased, since, due to the provision of a further cam part for each cam, a further shift position can be used, for example in order to achieve deactivation of a cylinder. Thus, in particular in connection with the overlapping arrangement of the gate track and the immediately adjacent cam, it is possible to produce a compact valve drive train device which at the same time can be flexibly shifted.

Furthermore it is proposed that the valve train device has a support shaft, on which the at least one cam element is non-rotatably but axially displaceably mounted. As a result, the cam elements can be simply subjected to a rotary movement.

Moreover it is proposed that the valve train device has an actuator unit with at least one gate engagement element for engagement in the at least one gate track, which is provided for shifting the at least one cam element. As a result, a changeover mechanism for shifting the cam element can be simply implemented.

The invention will become more readily apparent from the following description of an exemplary embodiment of the invention with reference to the accompanying drawings.

DESCRIPTION OF A PARTICULAR EMBODIMENT OF THE INVENTION

Figure 1:
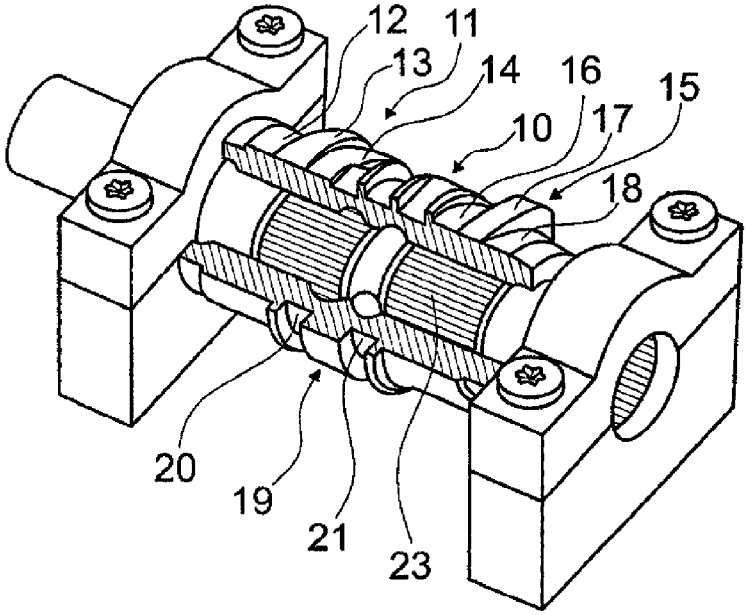
FIG. 1 shows a perspective representation of a valve drive train device according to the invention and FIG. 2 shows the valve train device in a plan view.
Figure 2:
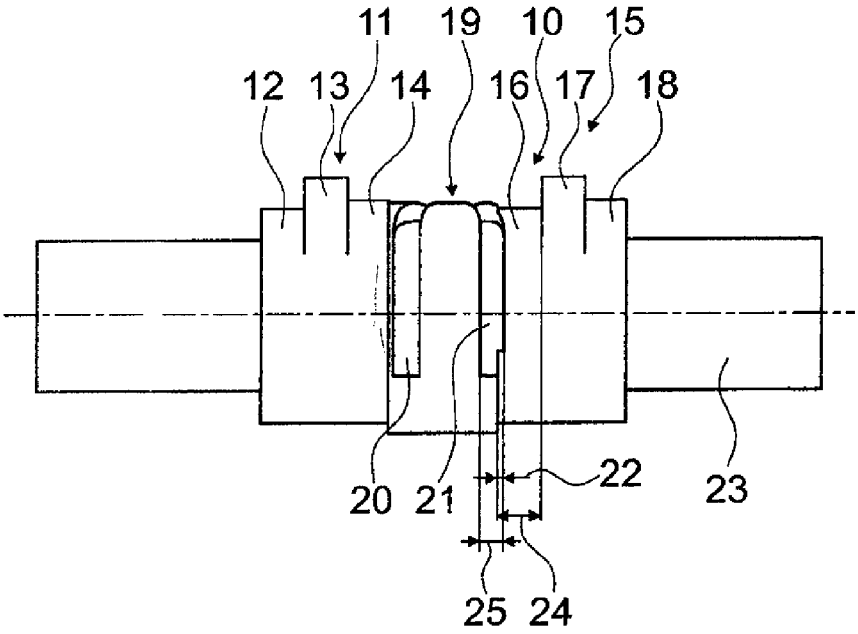

FIGS. 1 and 2 show a valve train device for an internal combustion engine. The valve train device comprises a support shaft 23 which is connected by means of a crankshaft drive (not shown in greater detail) to a crankshaft of the internal combustion engine. In addition, a camshaft phase adjuster, which is provided to adjust a phase position between the crankshaft and the support shaft 23, can be disposed between the support shaft 23 and the crankshaft.

Furthermore, the valve train device comprises a plurality of cam elements 10 which are axially displaceably disposed on the support shaft 23. The cam elements 10, only one of which is illustrated, are non-rotatably connected to the support shaft 23. The illustrated cam element 10 comprises two sets of cams 11, 15, which are provided for actuation of gas change valves of an individual cylinder. The support shaft 23 with the cam elements 10 mounted thereon forms a camshaft for actuating the gas change valves of different cylinders of the internal combustion engine.

For changing over between different types of valve actuation, the cam element 10 has a shifting gate 19 with two gate tracks 20, 21. The gate tracks 20, 21 are provided in order to convert a rotary movement of the cam element 10 into an axial shifting motion. The gate tracks 20, 21 each have an engagement segment, at least one shifting segment and one disengagement segment. The engagement segments and the disengagement segments each extend in the circumferential direction. The shifting segments additionally have an axial component. The gate tracks 20, 21 are designed in the form of grooves which are formed or cut into the cam elements 10.

For shifting the cam element 10, the valve train device also has an actuator unit with two gate engagement elements. Each of the gate engagement elements is associated with one of the gate tracks 20, 21. The gate engagement elements are designed as shift pins which, in the extended state, extend into the gate tracks 20, 21. The gate engagement elements are merely mounted displaceably along their main extension direction. The gate tracks 20, 21 and the associated gate engagement element are provided in each case for a shifting direction. Depending upon the shifting direction in which the cam element 10 is to be shifted, the corresponding gate engagement element is brought into engagement with the associated gate track 20, 21. The rotary movement of the cam element 10 causes the cam element 10 to be displaced in the axial direction by the axial component of the shifting segment of the corresponding gate track 20, 21 in conjunction with the stationary gate engagement element. All the cam elements 10 of the valve train device are designed in an analogous manner.

In the illustrated exemplary embodiment, the gate tracks 20, 21 are provided for shifting three different shift positions. The cam sets 11, 15 each have three part cams 12, 13, 14 and 16, 17, 18 with different cam curves. The respective first cam part 12, 16 is designed as a deactivation cam. It has a zero stroke and thus is provided for deactivation of a cylinder. The respective second cam part 13, 17 is designed as a full load cam. The respective third cam part 14, 18 is designed as a partial load cam.

In the axial direction, the shifting gate 19 with the two gate tracks 20, 21 is disposed between the two cam sets 11, 15. There is a first gate track 20 and an adjacent cam part 14 of the first cam set 11, which, in the axial direction, is disposed immediately adjacent to the gate track 20. Also, the second gate track 21 and the cam part 16 of the second cam set 15 are disposed immediately adjacent each other. However, the gate track 21 and the cam part 16 are shown in the axial direction to be disposed partially overlapping. A configuration of the gate track 20 and of the cam part 14 as well as a configuration of the gate track 21 and of the cam part 16 are in each case the same, and, for this reason, only the arrangement of the gate track 21 and of the cam part 16 are described below.

The cam parts 12, 13, 14 and 16, 17, 18 each have a base circle phase and the cam parts 13, 14 and 17, 18 have a certain lift range. In the base circle phase, the associated gas change valve is completely closed. In the axial direction, the gate track 21 extends into a part-region of the cam element 10 in which the cam part 16 of the cam set 15 is disposed. The cam part 16 and the gate track 21 are therefore disposed an overlapping relationship over an angular range of a camshaft angle of at least 20°. Over the angular range in which the cam part 16 and the gate track 21 are disposed axially overlapping, the cam part 16 has a reduced cam part width 24 with respect to the rest of its configuration.

In the base circle phase, the cam part 16 has a constant height. The gate track 21 and the cam part 16 are disposed partially axially overlapping in the base circle phase of the cam part 16. The angular range in which the gate track 21 and the cam part 16 are disposed in an axially overlapping relationship lies completely inside the base circle phase of the cam part 16.

The cam part 16 and the gate track 21 have an overlap width 22, which is between 10% and 50% of the cam part width 24, with respect to the cam part 16. With respect to the gate track 21, the overlap width 22 is likewise between 10% and 50% of a gate track width 25. As a result, the gate track 21 protrudes only partially into the axial part-region of the cam part 14.

In the illustrated exemplary embodiment, the disengagement segment of the gate track 21 is disposed axially overlapping with the cam part 16. The disengagement segment, which merely extends in the circumferential direction, is completely inside the angular region in which the gate track 21 and the cam part 16 are disposed overlapping.

Moreover, the shifting segment of the gate track 21 may also be disposed partially in the angular range in which the gate track 21 and the cam part 16 are disposed in axially overlapping relationship. In this angular range, the shifting segment of the gate track 21 merges into the disengagement segment in the angular range. A camshaft angle, by means of which the shifting segment is disposed overlapping with the cam part 16, is substantially less than the camshaft angle over which the disengagement segment overlaps with the cam part 16.

The valve train device has a cam follower (not shown in greater detail) which in the event of a rotation of the cam element 10 is actuated by the respective cam and provides for a valve lift that is opening of the respective gas change valve predetermined by the cam curve of the corresponding cam part 12, 13, 14 and 16, 17,18. The cam follower may be designed for example in the form of a roller cam follower or a roller type rocker arm. If the cam element 10 is shifted into a shift position in which the cam follower runs on the cam part 16 which is designed to axially overlap with the gate track 21, the gate track 21 extends only partially in each case below the cam follower.

LIST OF REFERENCE NUMERALS

10 cam element
11 cam
12 cam part
13 cam part
14 cam part
15 cam
16 cam part
17 cam part
18 cam part
19 shifting gate
20 gate track
21 gate track
22 overlap width
23 support shaft
24 cam part width
25 gate track width

What is claimed is:

1. A valve drive train device for an internal combustion engine of a motor vehicle, comprising: a camshaft with at least one axially movably mounted cam element (10), each axially movably mounted cam element (10) being provided with at least one cam set (11, 15) and each cam set (11, 15) including at least two cam parts (12, 13, 14; 16, 17, 18) and a shifting gate (19) with at least two gate tracks (20, 21) for converting a rotary movement of the at least one axially movably mounted cam element (10) into an axial shifting motion of the at least one cam element (10), with at least one of the cam parts (14, 16) and at least one of the gate tracks (20, 21) being disposed partially in an axially overlapping relationship.

2. The valve drive train device according to claim 1, wherein the cam part (14, 16) has a base circle area, and the gate track (20, 21) and a respective cam part (14, 16) are disposed axially overlapping in the base circle area of the respective cam part (14, 16).

3. The valve drive train device according to claim 2, wherein an overlap width (22) of the gate track (20, 21) and the respective cam part (14, 16) of at least 10% of a cam part width (24) is provided.

4. The valve drive train device according to claim 2, wherein an overlap width (22) of 50% of the gate track (20, 21) and the respective a cam part (14, 16) is provided.

5. The valve drive train device according to claim 1, wherein the at least one axially movably mounted cam element (10) has at least two cam sets (11, 15) each with at least two cam parts (12, 13, 14; 16, 17, 18) and the at least two gate tracks (20, 21) of the shifting gate (19) are disposed axially between the at least two cam sets (11, 15).

6. The valve drive train device according to claim 5, wherein each of the gate tracks (20, 21) of the shifting gate (19) is disposed at least partially axially overlapping with a respective adjacent cam part (14, 16) of the respective cam set (11,15).

7. The valve drive train device according to claim 1, wherein the gate tracks (20, 21) each include an engagement segment and, respectively, a disengagement segment at least one of which is disposed axially overlapping with the respective adjacent cam part (14, 16).

8. The valve drive train according to claim 1, wherein each cam set (11, 15) has a first cam part (12, 16), a second cam part (13, 17) and a third cam part (14, 18).

9. The valve drive train according to claim 1, wherein a support shaft (23) is provided on which the at least one cam element (10) is non-rotatably but axially displaceably mounted.

10. The valve drive train according to claim 1, wherein the at least one axially movable cam element (10) is axially movable by an actuator unit with gate engagement elements for engagement in the respective gate track (20, 21) for axially shifting the cam element (10) upon rotation thereof.

* * * * *